US005406651A

United States Patent [19]

Nogay

[11] Patent Number: 5,406,651

[45] Date of Patent: Apr. 18, 1995

[54] FEMALE URINAL APPARATUS

[76] Inventor: Claire M. Nogay, 1828 S. Gunderson Ave., Berwyn, Ill. 60402

[21] Appl. No.: 225,335

[22] Filed: Apr. 8, 1994

[51] Int. Cl.[6] ..... A61G 9/00

[52] U.S. Cl. ..... 4/144.3

[58] Field of Search ..... 4/144.1, 144.2, 144.3, 4/144.4, 450, 451, 452, 453, 454, 455, 456, 457

[56] References Cited

U.S. PATENT DOCUMENTS

| | | | |
|---|---|---|---|
| D. 286,569 | 11/1986 | Nakao et al. . | |
| 2,084,788 | 6/1937 | Anderson | 4/144.3 |
| 2,582,398 | 1/1952 | Siegenthal | 4/144.3 |
| 2,687,534 | 8/1954 | Johnson | 4/144.1 |
| 3,532,336 | 10/1970 | Baker | 4/450 |
| 3,877,083 | 4/1975 | Howe | 4/450 |
| 4,048,682 | 9/1977 | Smith | 4/450 |
| 4,121,306 | 10/1978 | Bringman et al. . | |
| 4,202,058 | 5/1980 | Anderson . | |
| 4,309,779 | 1/1982 | Knight | 4/144.1 |
| 4,764,991 | 8/1988 | Saleme . | |
| 4,769,858 | 9/1988 | Gamm et al. | 4/144.1 |
| 4,937,889 | 7/1990 | Strickland . | |
| 5,226,182 | 7/1993 | Tucker | 4/450 |

FOREIGN PATENT DOCUMENTS

| | | | |
|---|---|---|---|
| 106213 | 5/1917 | United Kingdom | 4/144.1 |
| 369151 | 3/1932 | United Kingdom | 4/457 |
| 720629 | 12/1954 | United Kingdom | 4/450 |

*Primary Examiner*—Henry J. Recla

*Assistant Examiner*—Charles R. Eloshway

[57] ABSTRACT

A new and improved urinal apparatus includes a urine retention housing which defines an interior urine-retention chamber. An entrance opening is provided in a first side wall portion of the urine retention housing, and a stabilization assembly is connected to the first side wall portion. The stabilization assembly is adapted to support the buttocks of a female user as the external genitalia are juxtaposed to the entrance opening, and the user urinates through the entrance opening into the interior urine-retention chamber. The entrance opening is positioned above the stabilization assembly on the first side wall portion of the urine retention housing. The entrance opening of the urine retention housing is adapted to encompass female genitalia as a female user urinates through the entrance opening into the interior urine-retention chamber. A handle assembly is connected to the top wall portion of the urine retention housing. A door assembly is connected to the urine retention housing for selectively opening and closing the entrance opening of the urine retention housing. The door assembly includes a door panel adapted to slidingly fit into door channels in the urine retention housing. The door assembly further includes a tether connected to the door panel and a ring connected to the tether. The urine retention housing includes a length dimension, a width dimension, and a height dimension. The length dimension is approximately three times greater than the width dimension.

7 Claims, 3 Drawing Sheets

FIG 1
PRIOR ART
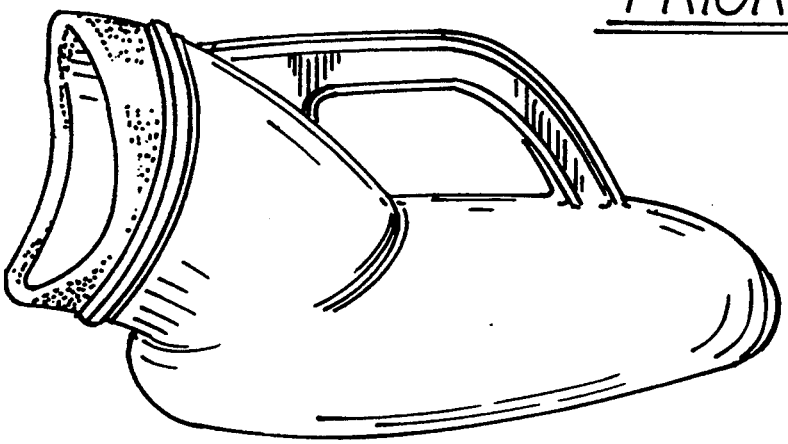
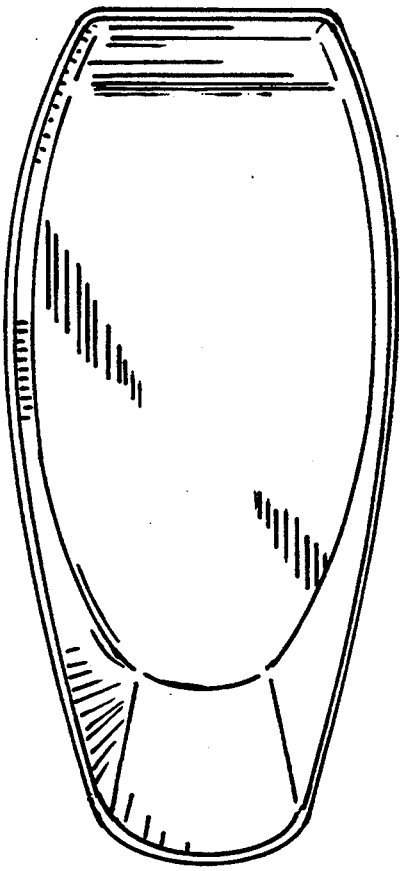
FIG 2
PRIOR ART

FIG 5
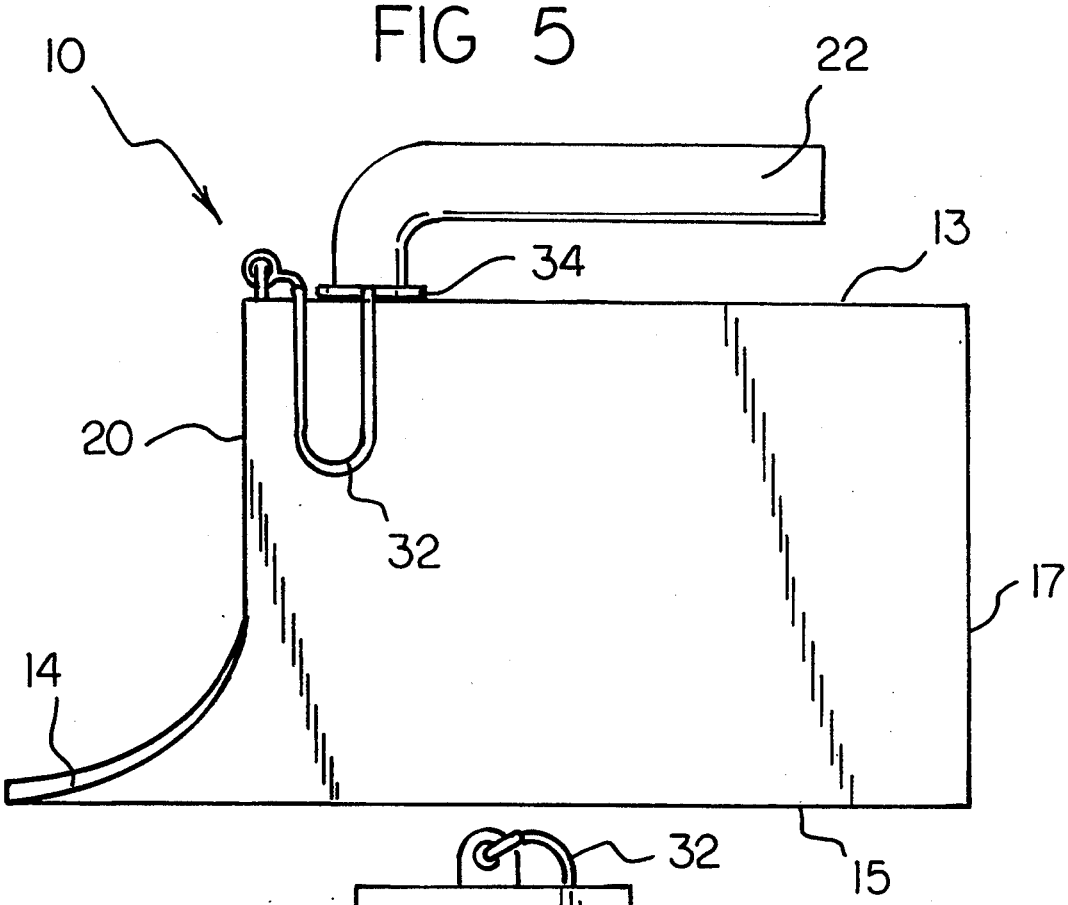
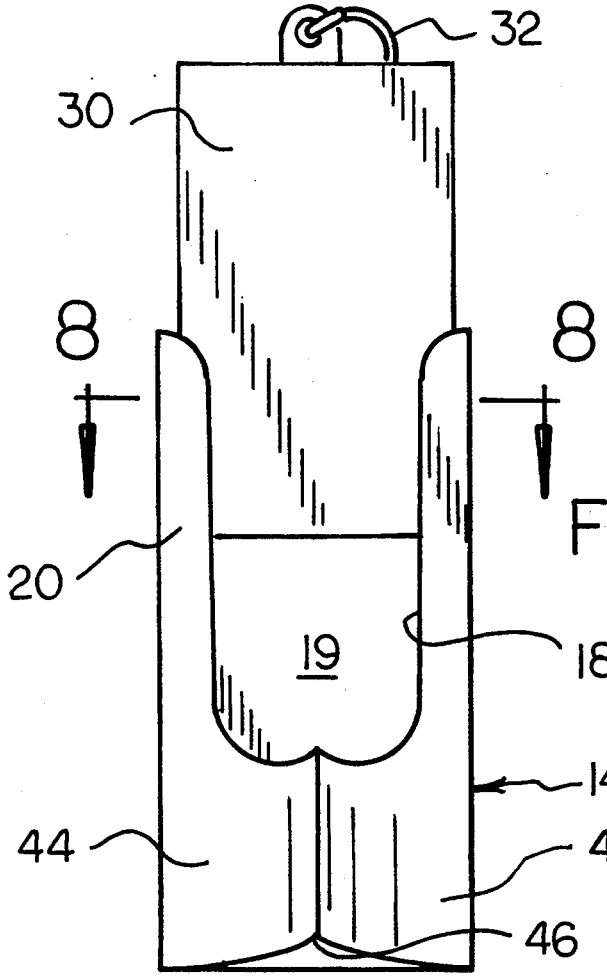
FIG 6

FEMALE URINAL APPARATUS

BACKGROUND OF THE INVENTION

1. Field of the Invention

The present invention relates generally to devices for receiving urine from patients and, more particularly, to devices especially adapted for receiving urine from female patients.

2. Description of the Prior Art

When a person is bed ridden, it is often necessary bring a receptacle to the person so that the person can urinate in the receptacle. Sometimes the person lies down in bed to urinate. At other times, the person is sitting in bed while urinating.

For a male, the presence of the male organ permits relatively easy control of the direction of a urine stream. For a female, however, directional control of the urine stream is quite difficult. Because directional control of a female urine stream is so difficult, it would be desirable if a urine receiving receptacle were provided that were especially adapted for receiving urine from a female patient.

There are a number of female urinals presently in use. However, these female urinals have to be held in place with someone's hands during urination. A person's illness may make it difficult for the person to hold the female urinal in place with one's hands. Alternatively, hospital personnel may hold the female urinal in place. However, receiving assistance of hospital personnel for the bodily function of urination may be embarrassing to the patient. Moreover, the hospital personnel may be needed to perform other functions. Generally, it would be desirable for a female patient to be able to carry out the urination function without the assistance of hospital personnel. It would also be desirable for a female patient to carry out the urination function without needing to hold a female urinal in place during urination.

Bed pans are often used to receive urine from bed ridden patients. However, for some people, the use of bed pans to receive urine is very difficult because the bladder is tilted the wrong way from the bed pan. For patients who cannot use a bed pan or cannot get out of bed, a urinary catheter may have to be used. However, a serious drawback of the use of a catheter is the susceptibility of infection. Thus, it would be desirable for a female urinal to be provided so that it is not necessary to use a bed pan. Moreover, it would be desirable for a female urinal to be provided so that the use of a urinary catheter may be precluded.

Another drawback of bed pans is that they are sometimes very difficult to place in position if the female patient is in traction, heavy, difficult to move, or elderly. In this respect, it would be desirable if a female urinal device were provided which is easy to use if the female patient is in traction, heavy, difficult to move, or elderly.

Bed pans are generally relatively flat-contoured devices which are not adapted to being hung from the side of a bed such as on a bed rail. For ease of accessibility to a female patient, however, it would be desirable for a urine receptacle to be adapted for hanging from the side of a bed such as from a bed rail.

Bed pans do not include lids which facilitate retention of urine within the bed pan. In this respect, it would be desirable if a female urinal device were provided with a lid that facilitates retention of urine within the urinal.

Some patients, such as patients with arthritis, do not have adequate finger facility for grasping a handle on a lid. In this respect, it would be desirable if a female urinal device were provided which includes a device for facilitating opening of a lid by persons who have arthritic fingers.

Bed pans generally do not include handles, but for ease of carrying a female urinal to a location for emptying and disposal of the retained urine, it would be desirable if the female urinal had a handle.

Throughout the years, a number of innovations have been developed relating to portable urinals in general and female urinals in particular, and the following U.S. Pat. Nos. are representative of some of those innovations: 4,121,306; 4,202,058; 4,764,991; 4,937,889; and Des. 286,569. More specifically, U.S. Pat. No. 4,121,306 discloses a urinal that appears to be designed for use by a male. On the other hand U.S. Pat. Nos. 4,202,058, 4,764,991, 4,937,889, and Des. 286,569 are specifically directed to female urinals. However, none of the disclosed female urinals disclosed in the cited patents overcomes the numerous problems and achieves the numerous goals set forth hereinabove.

Thus, while the foregoing body of prior art indicates it to be well known to use female urinals, the prior art described above does not teach or suggest a female urinal apparatus which has the following combination of desirable features: (1) permits a female patient to lie down in bed to urinate; (2) permits a female patient to sit in bed while urinating; (3) is especially adapted for receiving urine from a female patient; (4) enables a female patient to carry out the urination function without the assistance of hospital personnel; (5) does not require a female urinal to be held in place during urination; (6) eliminates the need of a bed pan for receiving urine from a female; (7) precludes the use of a urinary catheter; (8) is easy to use if the female patient is in traction, heavy, difficult to move, or elderly; (9) is adapted for hanging from the side of a bed such as from a bed rail; (10) is provided with a lid that facilitates retention of urine within the urinal; (11) includes a device for facilitating opening of a lid by persons who have arthritic fingers; and (12) has a handle. The foregoing desired characteristics are provided by the unique female urinal apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved urinal apparatus which includes a urine retention housing which includes a top wall portion, a bottom wall portion, and a plurality of side wall portions which define an interior urine-retention chamber. An entrance opening is provided in a first side wall portion, and a stabilization assembly is connected to the first side wall portion of the urine retention housing. The stabilization assembly is adapted to contact buttocks of a user as the user urinates through the entrance opening into the interior urine-retention chamber.

The entrance opening is proximal to the top wall portion of the urine retention housing, and the stabilization assembly is distal to the top wall portion of the urine retention housing. In this respect, the entrance opening is positioned above the stabilization assembly on the first side wall portion of the urine retention housing. The entrance opening of the urine retention housing is adapted to encompass female genitalia as a female user urinates through the entrance opening into the interior urine-retention chamber. A handle assembly is connected to the top wall portion of the urine retention housing.

The stabilization assembly includes a first curved sloped portion, a second curved sloped portion, and a peak portion located between the first curved sloped portion and the second curved sloped portion.

A door assembly is connected to the urine retention housing for selectively opening and closing the entrance opening of the urine retention housing. The urine retention housing includes a pair of door channels adjacent to the entrance opening, and the door assembly includes a door panel adapted to slidingly fit into the door channels. The door assembly further includes a tether is connected to the door panel. The door assembly further includes a ring which is connected to the tether.

The urine retention housing includes a length dimension, a width dimension, and a height dimension. The length dimension is greater than the width dimension. More specifically, the length dimension is approximately three times greater than the width dimension.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved female urinal apparatus which has all of the advantages of the prior art and none of the disadvantages.

It is another object of the present invention to provide a new and improved female urinal apparatus which may be easily and efficiently manufactured and marketed.

It is a further object of the present invention to provide a new and improved female urinal apparatus which is of durable and reliable construction.

An even further object of the present invention is to provide a new and improved female urinal apparatus which is susceptible of a low cost of manufacture with regard to both materials and labor, and which accordingly is then susceptible of low prices of sale to the consuming public, thereby making such female urinal apparatus available to the buying public.

Still yet a further object of the present invention is to provide a new and improved female urinal apparatus which permits a female patient to lie down in bed to urinate.

Still another object of the present invention is to provide a new and improved female urinal apparatus that permits a female patient to sit in bed while urinating.

Yet another object of the present invention is to provide a new and improved female urinal apparatus which is especially adapted for receiving urine from a female patient.

Even another object of the present invention is to provide a new and improved female urinal apparatus that enables a female patient to carry out the urination function without the assistance of hospital personnel.

Still a further object of the present invention is to provide a new and improved female urinal apparatus which does not require a female urinal to be held in place during urination.

Yet another object of the present invention is to provide a new and improved female urinal apparatus that eliminates the need of a bed pan for receiving urine from a female.

Still another object of the present invention is to provide a new and improved female urinal apparatus which precludes the use of a urinary catheter.

Yet another object of the present invention is to provide a new and improved female urinal apparatus that is easy to use if the female patient is in traction, heavy, difficult to move, or elderly.

Still a further object of the present invention is to provide a new and improved female urinal apparatus that is adapted for hanging from the side of a bed such as from a bed rail.

Yet another object of the present invention is to provide a new and improved female urinal apparatus which is provided with a lid that facilitates retention of urine within the urinal.

Still a further object of the present invention is to provide a new and improved female urinal apparatus that includes a device for facilitating opening of a lid by persons who have arthritic fingers.

Yet another object of the present invention is to provide a new and improved female urinal apparatus which has a handle.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the female urinal apparatus of the invention.

FIG. 2 is a side view of the embodiment of the female urinal apparatus shown in FIG. 1.

FIG. 5 is a cross-sectional view of the embodiment of the invention taken along line 5—5 of FIG. 3.

FIG. 6 is an enlarged, partial cross-sectional view of the embodiment of the invention shown in FIG. 4 taken along line 6—6 of FIG. 4.

DESCRIPTION OF THE PREFERRED EMBODIMENT

Figure 3:
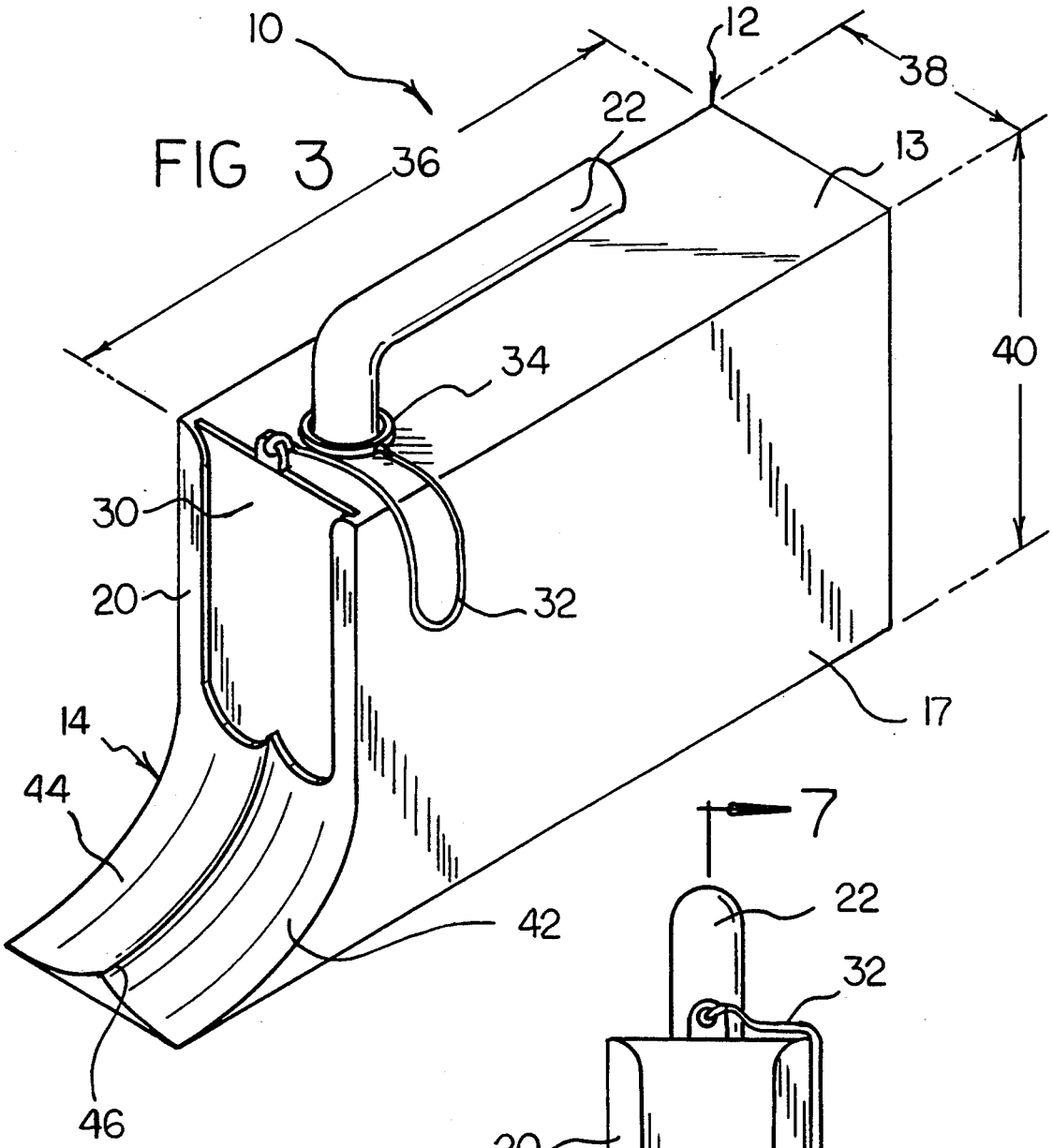
FIG. 3 is a front view of the embodiment of the female urinal apparatus of FIGS. 1 and 2 with the lid closed.

With reference to the drawings, a new and improved female urinal apparatus embodying the principles and concepts of the present invention will be described.

Turning to FIGS. 1–6, there is shown an exemplary embodiment of the female urinal apparatus of the invention generally designated by reference numeral 10. In its preferred form, female urinal apparatus 10 includes a urine retention housing 12 which includes a top wall portion 13, a bottom wall portion 15, and a plurality of side wall portions 17 which define an interior urine-retention chamber 19. An entrance opening 18 is provided in a first side wall portion 20, and a stabilization assembly 14 is connected to the first side wall portion 20 of the urine retention housing 12. The stabilization assembly 14 is adapted to contact buttocks of a user as the user urinates through the entrance opening 18 into the interior urine-retention chamber 19.

The entrance opening 18 is proximal to the top wall portion 13 of the urine retention housing 12, and the stabilization assembly 14 is distal to the top wall portion 13 of the urine retention housing 12. In this respect, the entrance opening 18 is positioned above the stabilization assembly 14 on the first side wall portion 20 of the urine retention housing 12.

The stabilization assembly 14 includes a first curved sloped portion 42, a second curved sloped portion 44, and a peak portion 46 located between the first curved sloped portion 42 and the second curved sloped portion 44. The first curved sloped portion 42 is adapted to conform to one buttock cheek. The second curved sloped portion 44 is adapted to conform to the other buttock cheek. The peak portion 46 is adapted to conform to the cleft between the two cheeks.

A door assembly is connected to the urine retention housing 12 for selectively opening and closing the entrance opening 18 of the urine retention housing 12. The urine retention housing 12 includes a pair of door channels 28 adjacent to the entrance opening 18, and the door assembly includes a door panel 30 adapted to slidingly fit into the door channels 28. The door assembly further includes a tether 32 connected to the door panel 30. The door assembly further includes a ring 34 which is connected to the tether 32.

The entrance opening 18 of the urine retention housing 12 is adapted to encompass female genitalia as a female user urinates through the entrance opening 18 into the interior urine-retention chamber 19. A handle assembly 22 is connected to the top wall portion 13 of the urine retention housing 12. The ring 34 of the tether 32 is adapted to fit around the handle assembly 22 for preventing the door panel 30 from is separated from the female urinal apparatus 10 of the invention.

The urine retention housing 12 includes a length dimension 36, a width dimension 38, and a height dimension 40. The length dimension 36 is greater than the width dimension 38. More specifically, the length dimension 36 is approximately three times greater than the width dimension 38. The actual sizes of the dimensions and the relative sizes of the dimensions control the urine-holding capacity of the interior urine-retention chamber 19 of the urine retention housing 12. Moreover, the actual sizes of the dimensions and the relative sizes of the dimensions greater influence the comfort that a female patient may have in using the female urinal apparatus 10 of the invention.

Figure 4:
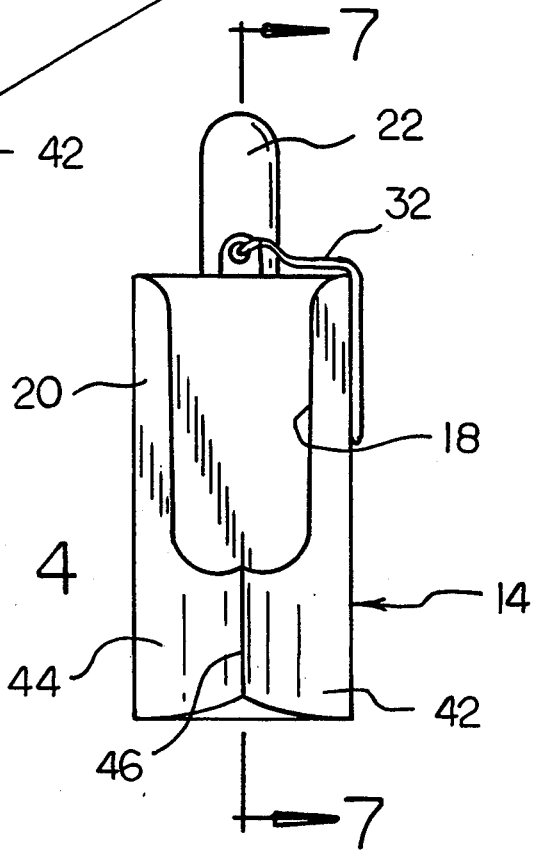
FIG. 4 is a front view of the embodiment of the invention shown in FIG. 3 with the lid opened.

In using the female urinal apparatus 10 of the invention, a female patient slides the stabilization assembly 14 under her buttocks so that the first curved sloped portion 42, the second curved sloped portion 44, and the peak portion 46 of the stabilization assembly 14 conform to the buttocks. The weight of the patient's buttocks against the stabilization assembly 14 serves to stabilize the female urinal apparatus 10 of the invention so that the patient does not need to use her hands to stabilize the apparatus. The patient then grasps the ring 34 and pulls on the tether 32, whereby the door panel 30 is slid up the door channels 28 in the urine retention housing 12 to open the entrance opening 18. A partially open entrance opening 18 is shown in FIGS. 4 and 5. The patient's genitalia are juxtaposed to the entrance opening 18, and urination is accomplished. The urine collects in the interior urine-retention chamber 19.

After urination, the door panel 30 is moved back down in the door channels 28 so that the entrance opening 18 is closed for retaining the urine in the interior urine-retention chamber 19. The patient grasps the handle assembly 22 and lifts the buttocks, permitting the female urinal apparatus 10 of the invention to be removed.

To empty the interior urine-retention chamber 19, the door panel 30 is completely removed from the door channels 28, and the female urinal apparatus 10 of the invention is tilted to a side as the handle assembly 22 is held. Thereby, the urine flows out of the interior urine-retention chamber 19, and the door panel 30 can remain tethered to the handle assembly 22 by the ring 34. The interior urine-retention chamber 19 and the exterior components can be cleaned with soap and water.

The components of the female urinal apparatus of the invention can be made from inexpensive and durable metal or plastic materials. When inexpensive plastic materials are used, the female urinal apparatus of the invention can be made from readily disposable materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved female urinal apparatus that is low in cost, relatively simple in design and operation, and which may advantageously be used to permit a female patient to lie down in bed to urinate. With the invention, a female urinal apparatus is provided which permits a female patient to sit in bed while urinating. With the invention, a female urinal apparatus is provided which is especially adapted for receiving urine from a female patient. With the invention, a female urinal apparatus is provided which enables a female patient to carry out the urination function without the assistance of hospital personnel.

With the invention, a female urinal apparatus is provided which does not require a female urinal to be held in place during urination. With the invention, a female urinal apparatus is provided which eliminates the need of a bed pan for receiving urine from a female. With the invention, a female urinal apparatus is provided which precludes the use of a urinary catheter. With the invention, a female urinal apparatus is provided which is easy to use if the female patient is in traction, heavy, difficult to move, or elderly. With the invention, a female urinal apparatus is provided which is adapted for hanging from the side of a bed such as from a bed rail. With the invention, a female urinal apparatus is provided which is provided with a lid that facilitates retention of urine within the urinal. With the invention, a female urinal apparatus is provided which includes a device for facilitating opening of a lid by persons who have arthritic fingers. With the invention, a female urinal apparatus is provided which has a handle.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A new and improved urinal apparatus, comprising:

a urine retention housing which includes a top wall portion, a bottom wall portion, a plurality of side wall portions which define an interior urine-retention chamber, and an entrance opening in a first side wall portion, and a stabilization assembly connected to said first side wall portion of said urine retention housing, said stabilization assembly adapted to contact buttocks of a user as the user urinates through said entrance opening into said interior urine-retention chamber, wherein said stabilization assembly includes a first concavely curved sloped portion adapted to contact a first buttock of a person, a second concavely curved sloped portion adapted to contact a second buttock of a person, and a peak portion located between said first concavely curved sloped portion and said second concavely curved sloped portion and adapted to extend into a crease between the first buttock and the second buttock of the person, and wherein said entrance opening is proximal to said top wall portion of said urine retention housing, wherein said stabilization assembly is distal to said top wall portion of said urine retention housing, and wherein said entrance opening is positioned above said stabilization assembly on said first side wall portion of said urine retention housing, a door assembly, connected to said urine retention housing, for selectively opening and closing said entrance opening of said urine retention housing, wherein said urine retention housing includes a pair of door channels adjacent to said entrance opening, and said door assembly includes a door panel adapted to slidingly fit into said door channels.

2. The apparatus described in claim 1 wherein said door assembly further includes a tether connected to said door panel.

3. The apparatus described in claim 2 wherein said door assembly further includes a ring connected to said tether.

4. The apparatus described in claim 1 wherein said entrance opening of said urine retention housing is adapted to encompass female genitalia as a female user urinates through said entrance opening into said interior urine-retention chamber.

5. The apparatus described in claim 1, further including:

a handle assembly connected to said top wall portion of said urine retention housing.

6. The apparatus described in claim 1 wherein:

said urine retention housing includes a length dimension, a width dimension, and a height dimension, and said length dimension is greater than said width dimension.

7. The apparatus described in claim 6 wherein said length dimension is approximately three times greater than said width dimension.

* * * * *